United States Patent [19]

Chow et al.

[11] 4,195,898

[45] Apr. 1, 1980

[54] PATCHCORD CONNECTOR

[75] Inventors: Weichien Chow, River Forest; Josef Keglewitsch, Addison, both of Ill.

[73] Assignee: Bunker Ramo Corporation, Oak Brook, Ill.

[21] Appl. No.: 864,943

[22] Filed: Dec. 27, 1977

[51] Int. Cl.[2] ..... H01R 13/38

[52] U.S. Cl. ..... 339/99 R; 339/103 R; 339/223 R

[58] Field of Search ..... 339/97 R, 97 P, 98, 339/99, 103 R, 223

[56] References Cited

U.S. PATENT DOCUMENTS

| | | | |
|---|---|---|---|
| 3,237,148 | 2/1966 | Ege | 339/103 R |
| 3,365,695 | 1/1968 | Harvey et al. | 339/99 R |
| 3,854,787 | 12/1974 | Snyder, Jr. | 339/103 R |
| 3,959,868 | 6/1976 | Mathe | 339/97 P |
| 3,993,391 | 11/1976 | Vernerey et al. | 339/97 R |
| 4,040,703 | 8/1977 | Shaffer et al. | 339/210 R |

FOREIGN PATENT DOCUMENTS

| | | | |
|---|---|---|---|
| 508583 | 2/1952 | Belgium | 339/99 R |
| 2520837 | 11/1975 | Fed. Rep. of Germany | 339/99 R |

*Primary Examiner*—Joseph H. McGlynn

*Attorney, Agent, or Firm*—F. M. Arbuckle; J. R. Hoffman

[57] ABSTRACT

A patchcord connector for use in terminating a plurality of insulated conductors and interconnecting the conductors to a modular terminal board includes a housing having first and second interlockable molded body members. A plurality of contact elements are disposed within the housing and include terminal contact portions having insulation-piercing members for terminating the insulated conductors as the body members are assembled and interlocked. To afford simple and rapid field assembly of the connector, the connector includes gripping members integral with each contact element for securely maintaining each insulated conductor in a terminating position within the connector prior to and during interlocking of the body members and termination of the conductors. Strain relief means are also provided for retaining each conductor within the connector housing when the first and second body members are in a finally assembled and interlocked position. In addition, to enable direct electrical testing of the contact elements, entrance assemblies are provided which permit limited access from the rear exterior of the housing to each contact element terminal portion when the body members are in an interlocked position and the conductors are fully terminated.

2 Claims, 8 Drawing Figures

PATCHCORD CONNECTOR

BACKGROUND OF THE INVENTION

This invention relates generally to electrical connectors and more particularly to patchcord connectors for terminating a plurality of insulated conductors and electrically interconnecting the conductors to a modular interconnection terminal board adapted for receiving a large number of densely arranged connectors. Specifically, the present invention relates to an improved patchcord connector having an improved strain relief mechanism, means for enabling electrical testing of the fully assembled and electrically interconnected patchcord connector, and means for affording rapid and easy field termination of the conductors within the connector.

In modular interconnection terminal devices for use in communications and data processing systems, and particularly in telephone systems, it is necessary to be able to interconnect one line or series of lines with any other selected line or series of lines leading to or from the modular terminal board. Patching systems are commonly used for this purpose and may be found, for example, in telephone exchanges, central offices, and large office or apartment buildings wherein a number of outside telephone lines must be interconnected with inside telephone lines. Since it is necessary to occasionally change these interconnections, such patching system interconnections are conventionally temporary in nature and are therefore preferably easy to connect and disconnect.

It is also desirable that such patchcord connectors generally be simple in construction and easy to assemble in the field. To this end, such connectors have generally included two engageable connector halves or parts which carry a plurality of contact elements to which one or more electrical conductors are terminated. These prior patchcord connector arrangements, however, have encountered a number of problems. For example, one common connector arrangement utilizes two connector parts having insulation piercing contact elements wherein the insulated conductors must be manually held in position while the connector parts are being clamped together. Such manipulation is cumbersome and at times difficult to achieve during field assembly of the connector at the site of the modular terminal board. In addition, some prior connectors have included partially pre-assembled parts in an attempt to obviate the above-mentioned problem. However, such partially pre-assembled connectors have generally been complex and expensive to fabricate.

Other prior patchcord connector designs have included an arrangement whereby two molded connector parts are hingedly interconnected by an integrally molded internally incorporated hinge with the conductors being clamped therebetween. However, such internally molded hinge arrangements often tend to cause molding problems during manufacturing of the connector.

U.S. patent application Ser. No. 722,674, filed Sept. 13, 1976 by J. Keglewitsch, and which is assigned to the assignee of the present invention, discloses a patchcord connector which overcomes many of the above-noted problems of prior patchcord connector designs. The patchcord connector disclosed therein includes a main body portion having insulation piercing contact elements and a cover hingedly secured to and engageable with the main body portion. The cover includes longitudinal bores for receiving the insulated conductors, and upon interlocking of the cover with the main body portion, the contact elements pierce the conductor insulation and terminate the conductors.

Several deficiencies, however, have been noted with this design. First, the design of the cover portion having bores molded therein for easy field termination of the insulated conductors requires more complex molding techniques which increase the manufacturing cost of the patchcord connectors. In addition, the hinge of this connector is incorporated within the connector body and thereby results in critical dimensions and locations for the various internal components of the connector due to the internal space required for the hinge mechanism. Furthermore, the strain relief arrangement provided by the patchcord connector of this patent application is typical of such strain relief mechanisms and includes a strain relief bar disposed within the connector housing transverse to the longitudinal axis of the conductor and which is received within a similarly transverse cross opening. This arrangement necessitates additional spacing between the contact elements to provide sufficient room for the cross openings. Thus, this arrangement further complicates the problem of critical internal component dimensions as well as limits the maximum number of contact elements and conductors which may be utilized with a given size connector housing. Moreover, the transverse orientation of the strain relief bar relative to the conductor may tend to cause breakage of the conductor.

Finally, it is occasionally desirable and even necessary to test the circuit of a fully assembled patchcord connector which is interconnected with a modular interconnection terminal board. Prior patchcord connectors, including that disclosed in the aforementioned U.S. patent application, were not designed to specifically provide such a capability. Therefore, testing probes were generally forcibly inserted between the connector housing and the conductor at the entry point of the conductor until the probe engaged some part of the terminal portion of the contact element. This forcible insertion of a testing probe occasionally results in breakage of the conductor or disturbance of the electrical connection between the conductor and the contact element.

SUMMARY OF THE INVENTION

Therefore, the present invention is directed to an improved patchcord connector which overcomes the above-mentioned deficiencies of prior patchcord connector arrangements.

Particularly, it is an object of the present invention to provide an improved patchcord connector which enables rapid and easy pre-alignment of the electrical conductors with the connector contact elements during field assembly of the patchcord connector and which is capable of being fully assembled in the field without the use of any tools.

A further object of the present invention is to provide an improved patchcord connector having an integral strain relief mechanism which reduces the criticality of connector component dimensions, reduces the possibility of conductor breakage, and enables use of a greater number of contact elements for a given size patchcord connector.

Yet another object of the present invention is to provide an improved patchcord connector which enables easy and rapid electrical testing of the contact elements of a fully assembled patchcord connector interconnected with a modular terminal board.

Accordingly, the present invention is directed to a patchcord connector for terminating at least one and preferably a plurality of insulated conductors and electrically interconnecting the terminated conductors to a modular interconnection terminal board or the like. The patchcord connector preferably includes a housing having first and second interlockable body members. In preferred form, the first body member is a base member which includes a plug portion having at least one leg member projecting therefrom in alignment with a longitudinal groove disposed along the planar inner surface of the base member. The second body member is preferably a cover member which is interlockable with the base member and connected thereto by a flexible strap hinge. At least one and preferably a plurality of contact elements are disposed within the connector housing, and each contact element includes an active portion disposed within a leg member and a terminal portion located within one of the base member grooves for terminating an insulated conductor.

Means for piercing the insulation of each insulated conductor are provided within the connector housing to terminate the conductor when the two body members are pressed and interlocked together to fully assemble the connector. In addition, the connector includes means integral with each contact element for securely maintaining each insulated conductor in a terminating position within the connector immediately adjacent the terminal portion of the contact element prior to and during termination of the conductor and interlocking of the body members. This permits rapid and simple field assembly of the subject patchcord connector.

In preferred form, the integral conductor maintaining means includes at least one and preferably two or more gripping members which are adapted to engage the insulation of the conductor as the conductor is brought into positional alignment with the contact element terminal portion. Furthermore, the gripping members provide strain relief for the conductor during assembly of the connector housing.

The patchcord connector of the present invention also includes improved strain relief means for each conductor within the connector housing when the first and second body members are fully interlocked. In the preferred form, each strain relief means includes an elongated projection or bar member which projects from the inner planar surface of the cover member and is in longitudinal alignment with a contact element. In addition, the base member includes an elongated aperture therein for receiving the bar member, and the bar member is adapted to deform and press the insulated conductor longitudinally into the base member aperture when the cover and base members are fully assembled and interlocked. This feature decreases the amount of spacing required between adjacent contact elements within the connector housing for strain relief purposes.

To facilitate simple and efficient electrical testing of a contact element in the fully assembled and interconnected pachcord connector of the present invention, entrance means are provided for permitting limited access from outside the connector housing to each contact element terminal portion when the body members are in an interlocked position and the conductors are fully terminated. In a preferred form, each entrance means includes a divergently flared portion at the rear end of each base member groove which provides a widened entrance opening at the terminal end of the housing through which a conductor passes. In addition, the terminal portion of each contact element includes spaced-apart and correspondingly divergent or flared flange members which extend along a portion of the divergent sidewalls of the groove end. This provides a limited space between the emerging conductor and the connector housing so that a testing probe can be inserted therethrough to readily engage one of the recessed flared flange members.

BRIEF DESCRIPTION OF THE DRAWINGS

The novel features which are believed to be characteristic of the present invention are set forth in the appended claims. The invention itself, however, together with further objects and attendant advantages thereof, will become apparent and best understood by reference to the following detailed description taken in connection with the accompanying drawings, setting forth by way of illustration and example certain embodiments of the invention in the several figures of which like reference numerals identify like elements, and in which:

DETAILED DESCRIPTION OF THE PREFERRED EMBODIMENT

Figure 1:
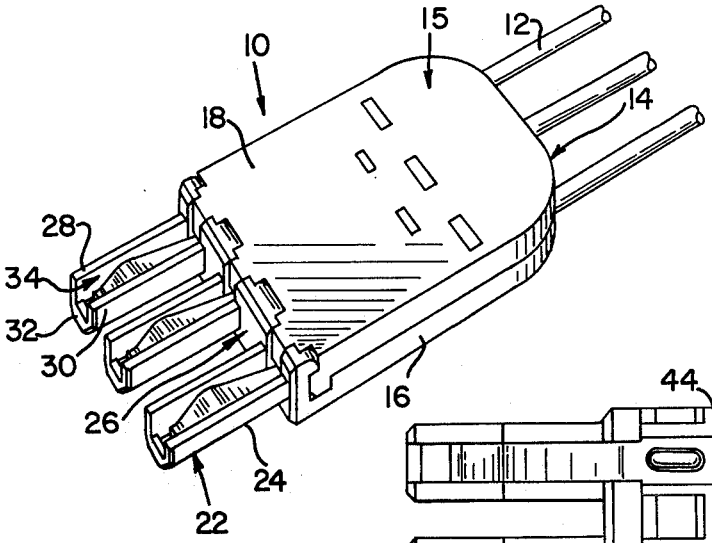
FIG. 1 is a perspective view of a patchcord connector constructed in accordance with the present invention.
Figure 7:
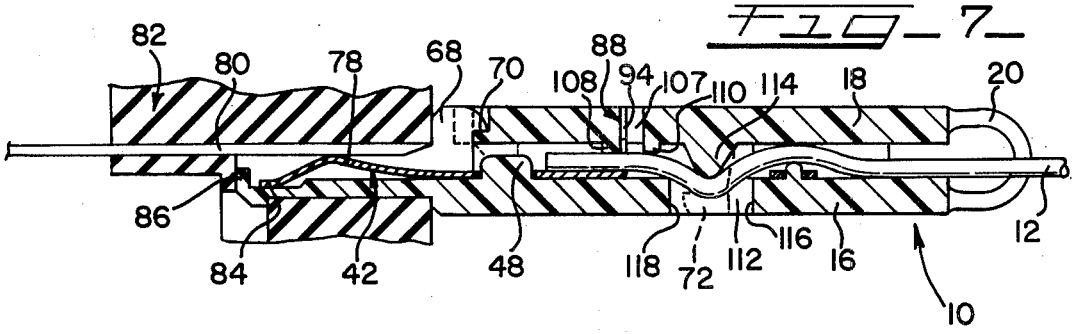
FIG. 7 is a cross-sectional view of a patchcord connector constructed in accordance with the present invention and inserted into a modular interconnection terminal receptacle for interconnection therewith.
Figure 2:
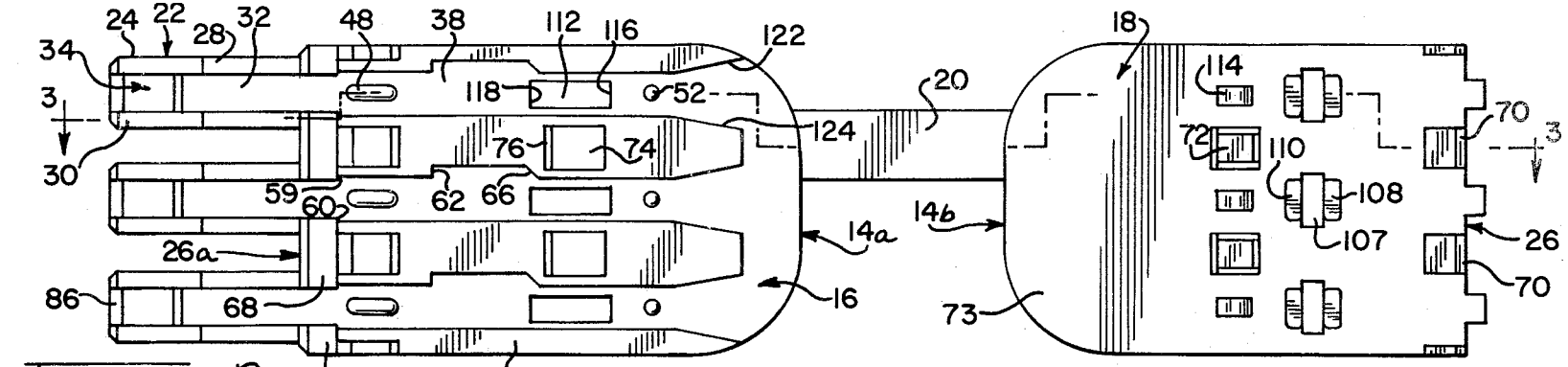
FIG. 2 is a top plan view of a patchcord connector housing of the present invention in an open, unassembled position and illustrating the interior construction of the housing components.
Figure 3:
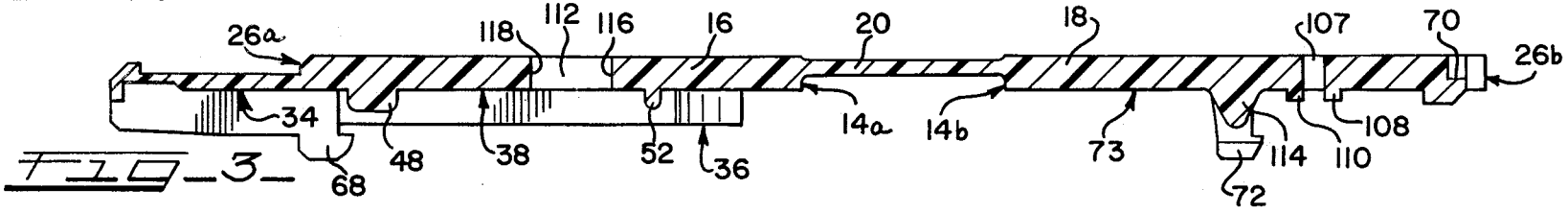
FIG. 3 is a cross-sectional view taken substantially along line 3—3 of FIG. 2.
Figure 4:
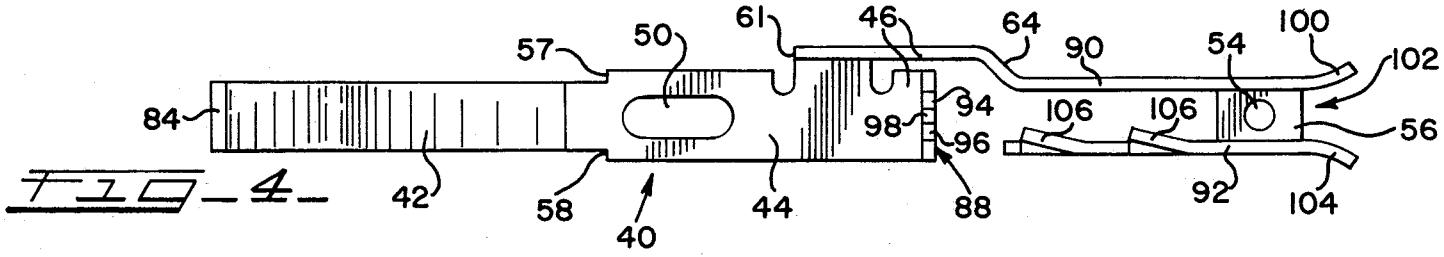
FIG. 4 is an enlarged top plan view of a preferred contact element utilized with the patchcord connector of the present invention.
Figure 5:
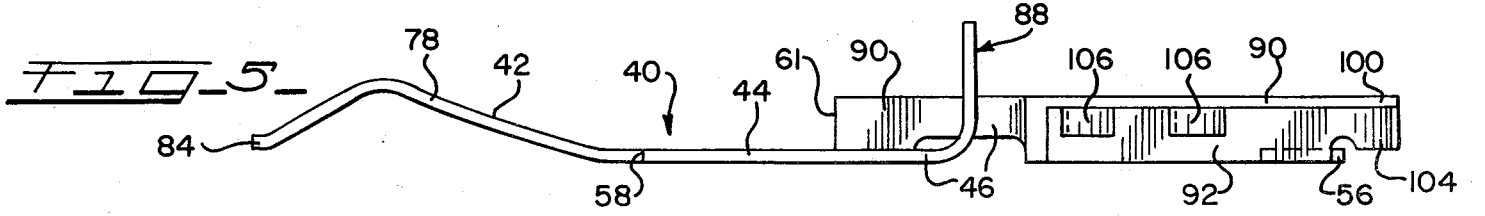
FIG. 5 is an enlarged side elevation view of the contact element illustrated in FIG. 4.

Referring first to FIGS. 1 through 3, a patchcord connector 10 is shown having a plurality of insulated conductors 12 terminated therein and projecting from the rear or terminal end 14 of a connector housing 15. The housing 15 in preferred form includes two body members in the form of a base member 16 which is interlockable with a cover member 18. The base and cover members 16 and 18 and the component parts thereof, as described in detail below, may be formed from any suitable dielectric material and are preferably constructed from a substantially firm plastic using conventional molding techniques. The base member 16 and the cover member 18 are preferably hingedly secured together by an elongated flexible strap hinge 20 which intergrally interconnects the rear end portions 14*a* and 14*b*, respectively, of the body members 16 and 18. When the base and cover members 16 and 18 are in their fully engaged position, the hinge 20 forms a loop, as illustrated in FIG. 7, which may be utilized for conveniently removing the connector 10 from an interconnected position with a modular terminal board. The strap hinge 20 insures that the body members 16 and 18 will not become inadvertently separated from each other, yet does not require sophisticated molding techniques nor affect the dimensions of the internal structural components of the body members 16 and 18.

In the illustrated embodiment, the base member 16 includes a plug portion 22 which preferably has one leg member 24 for each conductor 12 to be terminated within the connector 10. Each leg member 24 projects outwardly from the front portion 26 of the housing 15 for engagement with mating receptacles on a modular terminal board. Each leg member 24 preferably includes two spaced-apart sidewalls 28 and 30 and a bottom wall 32 which together define a longitudinal channel 34. In addition, the inner planar surface 36 of the base member 16 includes an elongated groove 38 which is aligned with and extends from the channel 34 to the rear end 14*a* of the base member 16.

Referring more particularly to FIGS. 4–7, the patch-cord connector 10 includes at least one and preferably a plurality of electrical contact elements 40 disposed within the connector 10. In the illustrated embodiment, each contact element 40 includes an active contact portion 42 seated within the channel 34 of a leg member 24, and intermediate and active contact portions 44 and 46, respectively, disposed within an aligned groove 38. The terminal contact portion 46 is adapted for terminating one insulated conductor 12, as described in greater detail below.

Each contact element 40 is preferably press-fitted within a groove 38, and to retain the contact 40 firmly therewithin, an integral elongated lug 48 is disposed longitudinally within the groove 38 and cooperatively engages a similarly shaped elongated aperture 50 within the intermediate portion 44 of the contact element 40. In addition, an integral pin 52 projects outwardly from the groove 38 and is cooperatively engageable with an aperture 54 disposed in a cross bracket 56 located in the terminal contact portion 46. To insure proper seating of the contact element 40 within the groove 38 and to prevent forward or rearward movement thereof within the assembled connector 10, the intermediate contact portion 44 preferably includes forward facing lip portions 57 and 58 which abut against, respectively, rearward facing shoulders 59 and 60 disposed within the groove 38. In addition, the contact element 40 includes a forward facing ledge 61 which engages a shoulder 62 extending into the groove 38, and a rearward angular face 64 which abuts an oppositely disposed angular face 66 located along the sidewall of the groove 38.

Referring to FIGS. 2 and 3, means for interlocking the cover member 18 to the base member 16 are disposed toward the rear portion 14 and the front portion 26 of the housing 15. In preferred form, a plurality of front latch members 68 are disposed on the forward end 26*a* of the base member 16 and are engageable with a plurality of recessed shoulders 70 disposed on the front portion 26*b* of the cover member 18. In addition, at least one and preferably two hook-shaped members 72 project from the inner planar surface 73 of the cover member 18 and are adapted to extend through apertures 74 disposed within the base member 16 toward the rearward portion 14*b* and engage ledges 76 located along the edges of the apertures 74. In this manner, the latch members 68 and the hook-shaped members 72 firmly interlock the base member 16 with the cover member 18 when the two body members are folded along the hinge 20 and pressed against each other.

Referring to the detailed structure of the contact element 40 as illustrated in FIGS. 4–7, the active contact portion 42 preferably includes a bowed section 78 for engaging the active portion 80 of a respective contact member mounted in a modular terminal board 82. The active contact portion 42 also includes an end 84 which may be engageable with a shoulder member 86 disposed adjacent the end of the leg member 24 to prevent the contact element tip from being cracked during insertion of the connector 10 into the terminal board 82. The terminal portion 46 of the contact element 40 preferably includes an insulation-piercing member 88, a first terminal end sidewall 90, and a second terminal end sidewall 92. The insulation-piercing member 88 may be of any conventional construction and preferably includes a pair of upwardly extending, spaced-apart legs 94, 96 which extend generally perpendicular from the contact element 40 to define an insulation-piercing notch 98 therebetween. The manner of operation of the insulation-piercing member 88 in terminating a conductor 12 by piercing the insulation thereof is conventional and well known in the art.

The first and second terminal end sidewalls 90, 92 preferably project upwardly and are substantially perpendicular to the plane of the intermediate contact portion 44. The first sidewall 90 extends the entire length of the terminal portion 46 and is secured at its forward end adjacent the intermediate portion 44, the forward edge of the sidewall 90 forming the ledge 61. The first sidewall 90 terminates at its rearmost end in an extension member or flange 100 which is flared transversely outwardly relative to the longitudinal axis of the contact element 40. The second sidewall 92 only extends part of the length of the terminal portion 46 and is not connected to the intermediate portion 44. The second sidewall 92 is spaced-apart from and substantially parallel to the rear portion of the sidewall 90 and is connected thereto by the cross bracket 56 to define a longitudinal terminal portion channel 102 adapted to receive an insulated conductor 12. The second sidewall 92 likewise terminates at its rearmost end in a transversely outwardly flared extension member or flange 104. The flanges 100 and 104 flare outwardly away from each other to form a gradually decreasing entrance orifice to the channel 102.

Disposed along the inner surface of the second sidewall 92 opposite the first sidewall 90 is at least one and preferably a plurality of insulation gripping members 106. In the illustrated form, each gripping member 106 is preferably formed from a partially cut-out portion of the sidewall 92 bent inwardly therefrom to project toward the insulation piercing member 88 and is in the form of a barb-like flange. The gripping members 106 project into the channel 102 and are utilized for securely maintaining an insulated conductor 12 in a terminating position within the connector 10 prior to and during termination of the conductor 12 in the insulation piercing member 88. The terminating position of the conductor 12 consists of the conductor 12 being aligned longitudinally along the terminal portion 46 so that the conductor 12 lays across the top of the insulation piercing member 88 and is slightly inserted within the channel 102 to lightly engage the gripping members 106. This maintains the conductor 12 in proper positional alignment along the terminal portion 46 prior to and during closing and interlocking of the cover member 18 with the base member 16. The gripping members 106 also provide strain relief for the conductor 12 during termination thereof. As will be described below, the closing of the cover member 18 onto the base member 16 forces the conductor 12, initially in its terminating position, to engage the insulation piercing member 88 and be completely inserted within the channel 102 below the gripping member 106.

It should be noted that while the preferred embodiment of the present invention includes the two sidewalls 90 and 92 with the gripping members 106 being outwardly projecting, cut-out portions of the sidewall 92, other arrangements for the gripping members 106 are envisioned and deemed within the scope of the present invention. One such alternate embodiment includes only one sidewall 90 with the gripping members 106 projecting outwardly therefrom. In addition, the gripping members 106 may be separate pieces secured by soldering or the like to one of the sidewalls 90, 92, rather than being cut-out portions of a sidewall. Another possible alternate embodiment includes only one sidewall 90 with the gripping members 106 being integral parts of the base member 18 projecting into the groove 38 opposite from the one sidewall 90 rather than integral portions of the contact element 40.

To force each insulated conductor 12 into terminal engagement with an insulation piercing member 88, a plurality of elongated transverse apertures 107 are disposed in the inner surface 73 of the cover member 18 and are adapted for receiving the insulation piercing members 88. Substantially rectangular block members 108 and 110 are disposed on both longitudinal sides of each aperture 107 and transversely aligned relative to the longitudinal axis of the contact element 40, the block members 108 and 110 projecting outwardly from the inner surface 73. Thus, when a conductor 12 is in its terminating position relative to the contact element 40, and the cover member 18 is pressed against and interlocked with the base member 16, the block members 108 and 110 press against the conductor 12 and force it between the spaced legs 94, 96 into the notch 98 of the insulation piercing member 88 as the member 88 is received within the aperture 107. The insulation of the conductor 12 is thereby pierced and stripped by the legs 94, 96 to electrically engage and terminate the condcutor 12.

The gripping members 106 therefore enable the plurality of conductors 12 to be easily placed into their terminating positions within the base member 16 during assembly of the patchcord connector 10. Once the conductors 12 have been so positioned, the cover member 18 is simply pivoted about the loop hinge 20 and pressed against the base member 16, which action interlocks the members 18 and 16 while simultaneously terminates the conductors 12 within the terminal contact portions 46 of the contact elements 40. This permits rapid and simple field assembly of the subject patchcord connector 10.

With particular reference to FIGS. 2, 3, 6 and 7, strain relief means to prevent movement of the terminated conductors 12 from the terminal portions 46 are provided within the connector 10. In the illustrated form, the base member 16 includes a plurality of elongated apertures 112. Each aperture 112 is preferably rectangular in shape and is disposed within a groove 38 along the longitudinal axis thereof. In addition, each aperture 112 is preferably disposed immediately subjacent the gripping members 106 when the contact element 40 is positioned within the base member 16. This places the strain relief means of the present invention between the insulation piercing member 88 and the flared end flanges 100 and 104 of the contact element 40.

Disposed on the inner surface 73 of the cover member 18 are a plurality of elongated projections 114 which extend outwardly from the surface 73 and are adapted to be received within the apertures 112. Each of the elongated projections 114 is longitudinally aligned with the longitudinal axis of a contact element 40 when the cover member 18 is interlocked with the base member 16. In this manner, each projection 114 engages and presses an insulated conductor 12 out of engagement with the gripping members 106 and into an aperture 112 when the cover member 18 is pressed against and interlocked with the base member 16. In preferred form, the conductor engaging surface of each projection 114 is longitudinally curved so that the longitudinal ends of the projection 114 are tapered toward the surface 73 from the center portion thereof to provide smooth ramp surfaces for engagement with the conductor 12. When the projection 114 presses the conductor 12 into an aperture 112, the conductor 12 is engaged with and held securely against the longitudinal end walls 116 and 118 of the aperture 112, and this firm engagement provides the strain relief for the conductor 12.

It should be noted that since each of the apertures 112 is longitudinally aligned with the contact element 40 and is preferably narrower than the contact element 40, additional space between the contact elements 40 within the base member 16 is not required for strain relief purposes, as is the case of many previous patchcord connector arrangements. Thus, the dimensional criticality of the various components of the body members 16 and 18 is substantially reduced due to this elimination of spacing requirements between the contact elements 40. This feature also permits a greater number of contact elements 40 to be included, if so desired, within any given size of patchcord connector 10. In addition, reduction in the criticality of dimensions permits use of simpler and easier molding techniques for the body members 16 and 18 and therefore reduces manufacturing costs of the patchcord connector 10.

Figure 6:
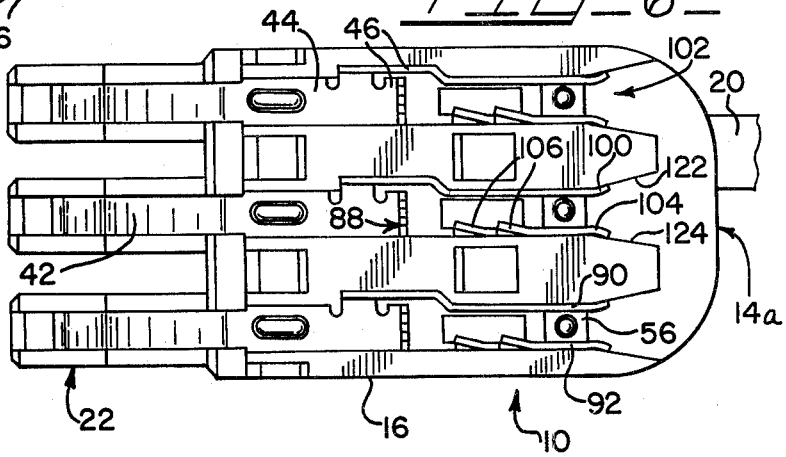
FIG. 6 is a top plan view of the base member of the connector housing illustrated in FIG. 2 and showing the contact elements of FIG. 4 positioned therewithin.
Figure 8:
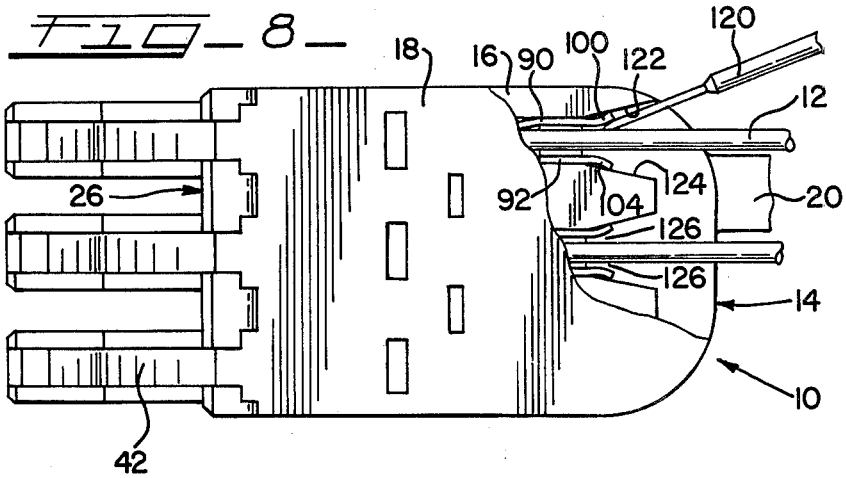
FIG. 8 is a top plan view of a patchcord connector constructed in accordance with the present invention in its fully assembled condition and showing a portion cut away to illustrate the insertion of a testing probe to engage the terminal portion of a contact element therein.

Referring to FIGS. 2, 6 and 8, the patchcord connector 10 of the present invention also includes an arrangement for providing limited access from the exterior of the housing 15 to each of the terminal portions 46 within the housing 15 when the body members 16 and 18 are in a fully interlocked position and each of the conductors 12 is fully terminated. As is common in the art, when a plurality of patchcord connectors such as the connector 10 are used in a patch system, the connectors are arranged in a highly dense fashion so that access to the connector is only at the rear portion 14. When a problem in the patch system circuitry arises, it is sometimes highly desirable to be able to test the circuit of a particular contact element 40 within the patchcord connector 10 when it is still interconnected with a terminal board 82. To achieve this, a probe as indicated at 120 is commonly used and inserted between the insulated conductor 12 at the rear portion 14 of the housing 15 and the opening for the conductor 12. The probe 120 is then commonly forced therein until it engages the contact element 40. With prior connector designs, this forcing of the probe 120 occasionally causes breakage of the conductor 12 and/or disturbance of the electrical connection between the conductor 12 and the contact element 40.

To permit such electrical testing while eliminating the aforementioned problems, the present invention includes divergent or outwardly flared sidewalls 122 and 124 at the rearward end of each groove 38 toward the rear portion 14 of the housing 10. The flared sidewalls 122 and 124 create a widened entrance portion at the rear 14 through which a conductor 12 passes, the entrance portion of the groove 38 gradually tapering inwardly toward the contact element 40. The flared end flanges 100 and 104 of the terminal portion 46 are sized and shaped to extend partially along the sidewalls 122 and 124, respectively, as illustrated in FIGS. 6 and 8. In this manner, the flared end flanges 100 and 104 are partially recessed within the entrance portion of the groove 38 as viewed from the rear 14 of the connector 10 to prevent inadvertent contact with and shorting of the contact element 40, yet the flared form of the flanges 100 and 104 create a tapered space 126 between each flange 100 and 104 and the terminated conductor 12. This arrangement permits quick and easy insertion of the probe 120 into the space 126 to contact either flange 100 or 104 and electrically test the circuit of the contact element 40. Furthermore, the tapered space 126 enables the probe to be sufficiently inserted therein so as to bias the probe between the flange 100 or 104 and the insulated conductor 12 to hold the probe 120 in place for a temporary period of time if necessary. Thus, this arrangement permits limited access from outside the housing 10 to each contact element terminal portion 46 when the connector 10 is fully assembled and interconnected to a modular terminal board 82.

To assemble the patchcord connector 10 in the field, the contact elements 40 are positioned within the appropriate grooves 38 within the open base member 16 and snap-locked in place. The appropriate number of insulated conductors 12 are then placed over the terminal portions 46 of the contact elements 40 and lightly pressed into terminating position so that the gripping members 106 engage the conductors 12 and lightly bias them against the opposite sidewalls 90. This maintains the insulated conductors 12 in place until the assembler has positioned all of the conductors for an individual patchcord connector 10. The cover member 18 is then simply rotated about the loop hinge 20 and positioned on the base member 16 so that the latch members 68 are aligned with the shoulders 70, and the hook-shaped members 72 are aligned with the apertures 74. The cover member 18 is then hand-pressed against the base member 16 so as to engage the latch members 68 with the shoulders 70 and the hook-shaped members 72 with the ledges 76. This action simultaneously terminates the conductors 12 within the insulation piercing members 88 and presses the conductors 12 into the apertures 112 to provide the appropriate strain relief. The fully assembled patchcord connector 10 is then ready for interconnection with the appropriate receptacle of a modular terminal board 82. Furthermore, if it is desired to test the electrical circuit of any one particular contact element at any time during the operation of the patch system, the probe 120 may be easily and quickly inserted within the entrance portion of the appropriate groove 38 so as to engage either a flange 100 or a flange 104.

As can be seen from the above, the present invention provides quick and simple assembly of the patchcord connector 10 without the use of tools. This is a result of the integral gripping members of the contact elements which permit easy pre-alignment and positioning of the conductors. Furthermore, the strain relief arrangement of the present invention substantially reduces the criticality of the internal component dimensions of the patchcord connector, and this feature substantially reduces the manufacturing cost of the connector as well as permits a greater number of conductors to be terminated within any given size patchcord connector. Finally, the present invention provides limited access to the terminal portions of the contact elements from outside the connector to permit testing of the electrical circuitry of the patchcord connector when the connector is fully interconnected with a modular terminal board. As a result of the present invention, such testing may be performed without subjecting the connector to conductor breakage or interference with the conductor connection to the contact element, yet inadvertent contact with the terminal portion and short-circuiting of the connector is prevented.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

We claim:

1. A patchcord connector for terminating at least one insulated conductor, comprising:

a housing having first and second interlockable body members and defining an exterior rear entrance orifice through which said conductor passes, said first body member defining at least one elongated groove therein in communication with said rear entrance orifice and along a surface adjoining said second body member when said body members are in an interlocked position;

at least one contact element having a terminal portion disposed within one said groove in said housing for terminating said conductor therein;

means for piercing the insulation of said conductor to terminate said conductor in said contact element;

means for maintaining said insulated conductor in terminating position within said connector prior to and during termination of said conductor in said contact element;

strain relief means for retaining said conductor within said housing when said body members are in a finally assembled and interlocked position; and entrance means to enable electrical testing of said contact element by providing limited access from the exterior of said housing to said contact element terminal portion when said body members are in said interlocked position and said conductor is fully terminated, said limited access permitting the insertion of a probe member within said housing, said entrance means including outwardly flared sidewalls disposed at the rearward end of said groove and opening to the exterior of said housing to define said entrance orifice, and extension members being electrically connected to said contact element terminal portion and having a pair of spaced-apart outwardly flared side flange members secured at the end of said terminal portion and adapted to extend partially along said sidewalls, the terminal ends of said flange members being recessed within said entrance orifice to provide limited access to said flange members by said probe member insertable within said orifice at the junction of one of said flange members and said insulated conductor to effect positive contact of said probe member with one of said extension members.

2. A patchcord connector for terminating at least one insulated conductor, comprising:

a housing having first and second interlockable body members and defining an exterior rear entrance orifice through which said conductor passes, said first body member defining at least one elongated groove therein in communication with said rear entrance orifice and along a surface adjoining said second body member when said body members are in an interlocked position;

at least one contact element having a terminal portion disposed within one said groove in said housing for terminating said conductor therein;

means for piercing the insulation of said conductor to terminate said conductor in said contact element; and entrance means to enable electrical testing of said contact element by providing limited access from the exterior of said housing to said contact element terminal portion when said body members are in said interlocked position and said conductor is fully terminated, said limited access permitting the insertion of a probe member within said housing, said entrance means including outwardly flared sidewalls disposed at the rearward end of said groove and opening to the exterior of said housing to define said entrance orifice, and extension members being electrically connected to said contact element terminal portion and having a pair of spaced-apart outwardly flared side flange members secured at the end of said terminal portion and adapted to extend partially along said sidewalls, the terminal ends of said flange members being recessed within said entrance orifice to provide limited access to said flange members by said probe member insertable within said orifice at the junction of one of said flange members and said insulated conductor to effect positive contact of said probe member with one of said extension members.

* * * * *